US007458350B2

(12) United States Patent
Diggs

(10) Patent No.: US 7,458,350 B2
(45) Date of Patent: Dec. 2, 2008

(54) ENGINE/VALVETRAIN WITH SHAFT-MOUNTED CAM FOLLOWERS HAVING DUAL INDEPENDENT LASH ADJUSTERS

(75) Inventor: Matthew Diggs, Farmington, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/680,565

(22) Filed: Feb. 28, 2007

(65) Prior Publication Data

US 2008/0202456 A1 Aug. 28, 2008

(51) Int. Cl.
*F01L 1/34* (2006.01)

(52) U.S. Cl. ..... 123/90.16; 123/90.43; 123/90.39

(58) Field of Classification Search ..... 123/90.16, 123/90.15, 90.43, 90.4, 90.22, 90.45, 90.61, 123/90.39

See application file for complete search history.

(56) References Cited

U.S. PATENT DOCUMENTS

| | | | | |
|---|---|---|---|---|
| 3,757,749 | A * | 9/1973 | Hatz | 123/90.22 |
| 4,393,820 | A | 7/1983 | Maki et al. | |
| 4,476,822 | A | 10/1984 | Bonvallet | |
| 4,763,616 | A | 8/1988 | Grinsteiner | |
| 4,864,983 | A | 9/1989 | Breitbarth | |
| 4,934,323 | A | 6/1990 | Grinsteiner | |
| 5,022,361 | A | 6/1991 | Schut | |
| 5,038,726 | A | 8/1991 | Pryba | |
| 5,490,485 | A * | 2/1996 | Kutlucinar | 123/190.4 |
| 5,560,265 | A | 10/1996 | Miller | |
| 5,617,818 | A | 4/1997 | Luders | |
| 5,657,726 | A | 8/1997 | Diggs | |
| 5,732,670 | A * | 3/1998 | Mote, Sr. | 123/90.24 |
| 5,809,956 | A | 9/1998 | Regueiro | |
| 5,862,785 | A | 1/1999 | Blowers et al. | |
| 6,047,675 | A | 4/2000 | Kunz | |
| 6,273,042 | B1 | 8/2001 | Perez et al. | |
| 6,484,682 | B2 | 11/2002 | Danesh et al. | |
| 6,513,472 | B2 | 2/2003 | Speil et al. | |
| 6,659,056 | B2 | 12/2003 | Sweetland | |
| 6,953,016 | B2 | 10/2005 | Karbstein et al. | |

(Continued)

FOREIGN PATENT DOCUMENTS

| | | | |
|---|---|---|---|
| GB | 403666 | A | 12/1933 |

(Continued)

OTHER PUBLICATIONS

UK Search Report dated Apr. 30, 2008 for App. No. GB0801734.5.

*Primary Examiner*—Zelalem Eshete
(74) *Attorney, Agent, or Firm*—Julia Voutyras; Brooks Kushman P.C.

(57) ABSTRACT

A multiple cylinder internal combustion engine having a valvetrain with a camshaft disposed within an engine block and at least two valves operated by a common camshaft lobe includes a stationary shaft disposed generally parallel to the camshaft and a cam follower having a first end with an opening pivotally mounted on the stationary shaft, a second end adapted for coupling to at least two pushrods each associated with one of the at least two valves, and a roller mounted on a roller axle disposed generally between the first and second ends, the roller contacting the common camshaft lobe. The cam follower may include independently operable lash adjusters for pushrods driven by a common camshaft lobe.

18 Claims, 3 Drawing Sheets

U.S. PATENT DOCUMENTS

| | | | |
|---|---|---|---|
| 6,962,134 | B1 | 11/2005 | Douse |
| 2002/0062805 | A1* | 5/2002 | Durr et al. |
| 2005/0056242 | A1 | 3/2005 | Murata et al. |
| 2007/0119397 | A1 | 5/2007 | Diggs et al. |

FOREIGN PATENT DOCUMENTS

| | | | |
|---|---|---|---|
| JP | 2000008949 | A | 1/2000 |

* cited by examiner

ENGINE/VALVETRAIN WITH SHAFT-MOUNTED CAM FOLLOWERS HAVING DUAL INDEPENDENT LASH ADJUSTERS

BACKGROUND

1. Technical Field

The present disclosure relates to an internal combustion engine having camshaft followers pivoting about a common shaft and each driving multiple push rods with independent lash adjusters.

2. Background Art

Conventional internal combustion engines use a camshaft-driven valvetrain to operate intake and exhaust valves that control the exchange of gases in the combustion chambers formed between the engine block and cylinder head. Engines are often categorized by the location of the camshaft relative to the valves, with overhead cam valvetrains driven by a camshaft in the cylinder head over the valves, and pushrod valvetrains or "cam-in-block" valvetrains having the camshaft located in the engine block with the valves operated using pushrods and rocker arms.

Current four-valve-per-cylinder pushrod engines include two intake valves and two exhaust valves for each cylinder. Each pair of valves is operated in tandem by a bridged valvetrain that includes a camshaft driven cam follower (also referred to as a tappet or lifter) connected by a single pushrod to a rocker arm that drives a bridge coupled to the pair of valves (intake or exhaust). The bridged valvetrain is a cost-efficient design that achieves acceptable performance for many applications, although operation of the two bridged valves is not precisely synchronized because the force exerted on the bridge can not be perfectly balanced between the valves, the valves may have slightly different spring forces, and the valve components may experience slightly different wear. This may result in one valve opening late and/or at valve closure, one valve may seat first causing the other valve to seat late with a higher than intended velocity. In addition, valve stem tips are edge loaded by the bridge with higher stresses resulting in higher rates of wear and potential noise, vibration, and harshness (NVH) concerns. While single overhead cam (SOHC) and dual overhead cam (DOHC) systems have independently controlled valves to address some of these issues, the SOHC and DOHC systems are significantly more expensive and have large package width relative to a cam-in-block design.

A lifter having multiple independently operable lash adjustment mechanisms has been developed to address these disadvantages as described in commonly owned and copending U.S. patent application Ser. No. 11/164,620 filed Nov. 30, 2005. One embodiment of a lifter disclosed in that application includes a body or housing having independently operable hydraulic lash adjusters with the body reciprocating within a bore in the engine block in response to camshaft rotation to actuate the associated pushrods, rocker arms, and valves. While the disclosed lifter provides a number of advantages relative to various prior art solutions, alternative implementations have since been developed that may provide additional advantages and/or be better suited for particular applications.

SUMMARY

A multiple cylinder internal combustion engine having a valvetrain with a camshaft disposed within an engine block and at least two valves operated by a common camshaft lobe includes a stationary shaft disposed generally parallel to the camshaft and a cam follower having a first end with an opening pivotally mounted on the stationary shaft, a second end adapted for coupling to at least two pushrods each associated with one of the at least two valves, and a roller mounted on a roller axle disposed generally between the first and second ends, the roller contacting the common camshaft lobe. The cam follower may include independently operable lash adjusters for pushrods driven by a common camshaft lobe.

In one embodiment according to the present disclosure, an internal combustion engine includes a plurality of shaft-mounted cam followers each coupled to at least two pushrods and having an independently operable hydraulic lash adjuster for each pushrod. The shaft is a non-rotating, stationary shaft disposed within the engine block and extends generally parallel to the camshaft. The independently operable hydraulic lash adjusters each include a housing with a sleeve disposed within a bore in the housing and have a closed end and an open end. A plunger is disposed within the sleeve and defines a first high-pressure chamber between the closed end and the plunger. A check valve is disposed between the plunger and the sleeve for controlling flow of hydraulic fluid from the plunger into the high-pressure chamber. The hydraulic fluid in the high-pressure chamber cooperates with the plunger spring to remove lash associated with the push rod, rocker arm, first valve.

One embodiment of a method for actuating at least two intake or exhaust valves associated with a single cylinder in a cam-in-block multiple cylinder internal combustion engine according to the present disclosure includes actuating the at least two intake/exhaust valves substantially simultaneously in response to rotation of an associated camshaft lobe by pivoting a shaft-mounted cam follower coupled to at least two corresponding pushrods and rocker arms. The method may also include independently hydraulically adjusting lash associated with each push rod and rocker arm.

The present disclosure includes embodiments having various advantages. For example, embodiments according to the present disclosure include a dedicated lash adjuster for each valve associated with a particular cam follower to compensate for thermal, wear, and tolerance effects and to insure that the valve motion remains very close to the design intent throughout the life of the engine. A common cam follower for multiple valve operation having independent lash adjusters according to the present disclosure may reduce or eliminate noise, vibration, and harshness associated with valve pairs failing to open or close together and/or having different or higher than intended seating velocities. The independently operable lash adjusters within a common follower provide coupled, synchronous motion for each valve pair and allow individual compensation for valve spring force differences, differences in valve/seat wear, and differences due to the rocker arm force not being applied at the mid-point between valve centerlines. In addition, the cam followers of the present disclosure eliminate wear mechanisms associated with bridged valvetrain implementations, such as pitching and rolling of the bridge resulting in increased stresses on the bridge/rocker arm interface and undesirable contact between the bridge and valve stem tips. A common follower with multiple independently operable hydraulic lash adjusters pivoting on a fixed shaft may reduce the moving mass of the valvetrain to improve performance. A shaft mounted cam follower according to the present disclosure may also reduce machining complexity of the engine block and/or facilitate weight reduction by reducing or eliminating structural features associated with a reciprocating lifter bore in the engine block.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a four-stroke, multi-cylinder, direct-injected compression-ignition internal combustion engine having a cam-in-block or pushrod valvetrain. Although a "V" engine configuration is illustrated, the cam followers of the present disclosure may also be used in engines having an in-line configuration. Those of ordinary skill in the art may recognize similar applications or implementations with other engine/vehicle technologies.

FIGS. 1-5 illustrate operation of an internal combustion engine and valvetrain according to a representative embodiment. Multiple cylinder internal combustion engine 10 is generally of conventional design with the exception of various valvetrain components as described herein. As such, various conventional features associated with the engine and valvetrain are not explicitly illustrated or described. Those of ordinary skill in the art will recognize that the present invention may be used in various types and configurations of engines including but not limited to compression ignition and spark ignition engines arranged in a "V" configuration or an in-line configuration, for example. The representative embodiments illustrated include a four valve-per-cylinder compression ignition diesel engine. However, cam followers according to the present disclosure may be used in any applications having at least two gas exchange valves including applications having at least one intake valve and/or at least one exhaust valve. Similarly, the cam followers of the present disclosure are particularly suited for use in engines having multiple valves controlled substantially simultaneously by a single camshaft lobe and associated shaft-mounted cam follower. While the present invention is illustrated in a cam-in-block engine configuration using pushrods to actuate the intake and exhaust valves (also referred to as a type-5 valvetrain), the invention may also be applied to applications where the rocker arms are directly actuated by a camshaft via a lifter (also referred to as a type-4 valvetrain). Those of ordinary skill in the art will recognize various other engine configurations in which a shaft mounted cam follower having independently operable hydraulic lash adjusters according to the present disclosure may be beneficial.

Figure 1:
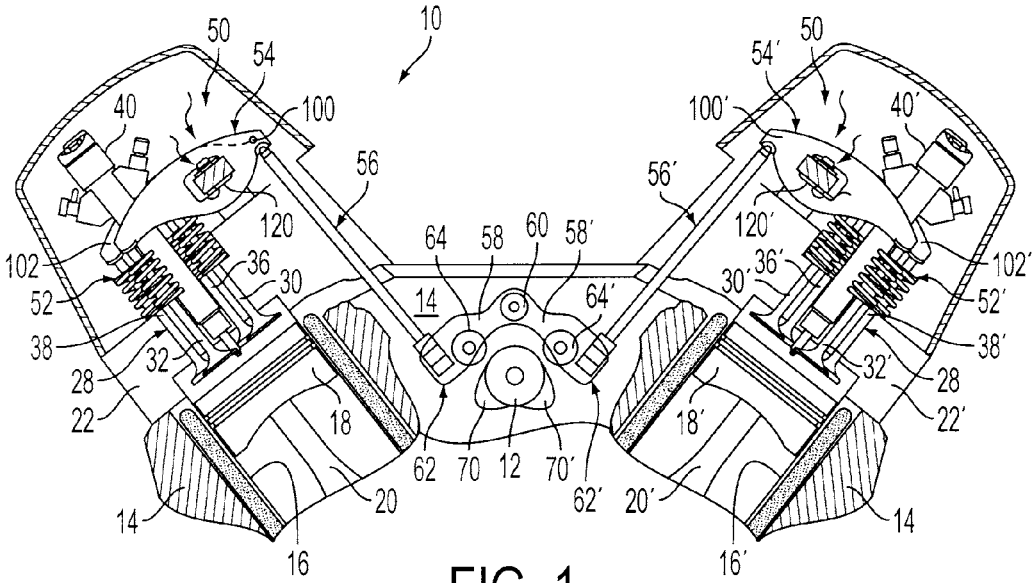
FIG. 1 is a partial cross-section illustrating a cam-in-block, "V" engine having shaft-mounted cam followers with independent lash adjusters according to one embodiment of the present disclosure.

As shown in the partial cut-away/cross-section of a representative application in FIG. 1, multiple cylinder internal combustion engine 10 includes a camshaft 12 disposed within an engine block 14, and may be referred to as a cam-in-block engine. As used throughout this disclosure, primed reference numerals identify components that correspond in structure and function to unprimed reference numerals. Those of ordinary skill in the art will recognize that the components need not be identical to perform the same function and have the same structure.

Each cylinder 16 (and 16') includes a reciprocating piston 18 (18', etc.) coupled by a connecting rod 20 to a crankshaft (not shown). Each bank of cylinders includes a cylinder head 22 secured to engine block 14 and provides conventional intake and exhaust passages (not shown) coupled to corresponding ports in the cylinder heads associated with gas exchange valves 28, which include intake valves 30, 32 and exhaust valves 36, 38. Cylinder head 22 includes conventional hardware such as valve guides, seats, etc. (not shown) associated with operation of gas exchange valves 28. A fuel injector 40 delivers fuel to cylinder 16 in response to a signal provided by an associated engine controller. Although a direct injection engine is illustrated in FIG. 1, the cam followers of the present disclosure may be used in engines having other fuel injection strategies, such as port injection, for example.

Engine 10 includes a valvetrain 50 to control intake of air and/or fuel (for port injected engines) into cylinder 16 and exhaust of combustion gases. Valvetrain 50 includes valves 28, valve springs 52, rocker arms 54, pushrods 56, and cam followers 58, which are mounted for pivoting about a stationary shaft 60 disposed within engine block 14 and extending generally parallel to camshaft 12. Camshaft 12 includes lobes 70 to actuate valves 28. In one embodiment, camshaft 12 includes a single lobe to operate a pair of intake valves 30, 32 and another single lobe to operate a pair of associated exhaust valves 36 and 38 (See FIG. 3). As such, each cam follower 58 may include independently operable hydraulic lash adjusters 62 to adjust lash associated with each of the pair of pushrods, rocker arms, and valves.

Figure 2:
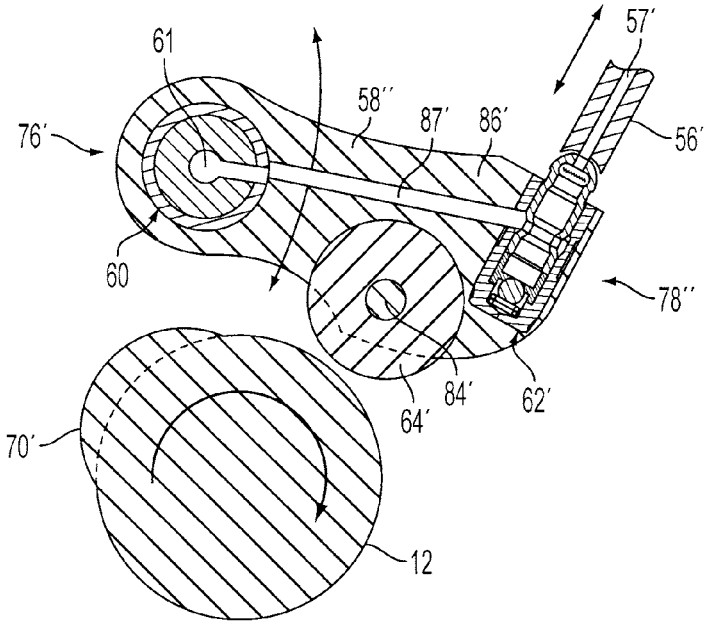
FIG. 2 is a cross-section of a representative embodiment of a shaft-mounted cam follower according to the present disclosure.

As shown in FIGS. 1-2, each cam follower 58 includes a roller 64 in contact with a cam or lobe 70 of camshaft 12. As camshaft 12 rotates during operation of engine 10, cam lobe 70 raises cam follower 58 to pivot about stationary shaft 60, which lifts two or more pushrods 56 that are coupled to corresponding rocker arms 100, 102. Each rocker arm 100, 102 pivots in a single plane about an integral ball/socket fulcrum 120, which is secured to cylinder head 22 as known in the art. Rocker arms 100, 102 translate the generally upward motion from pushrods 56 to a generally downward motion to move valves 28 against associated springs 52 to open associated intake/exhaust ports to cylinder 16. As camshaft 12 continues rotating, cam follower 58 follows the profile of lobe 70 and begins a generally downward motion so that the associated springs 52 close intake valves 30, 32.

Actuation of exhaust valves 36, 38 proceeds in a similar manner based on the profile of lobe 70'.

Figure 3:
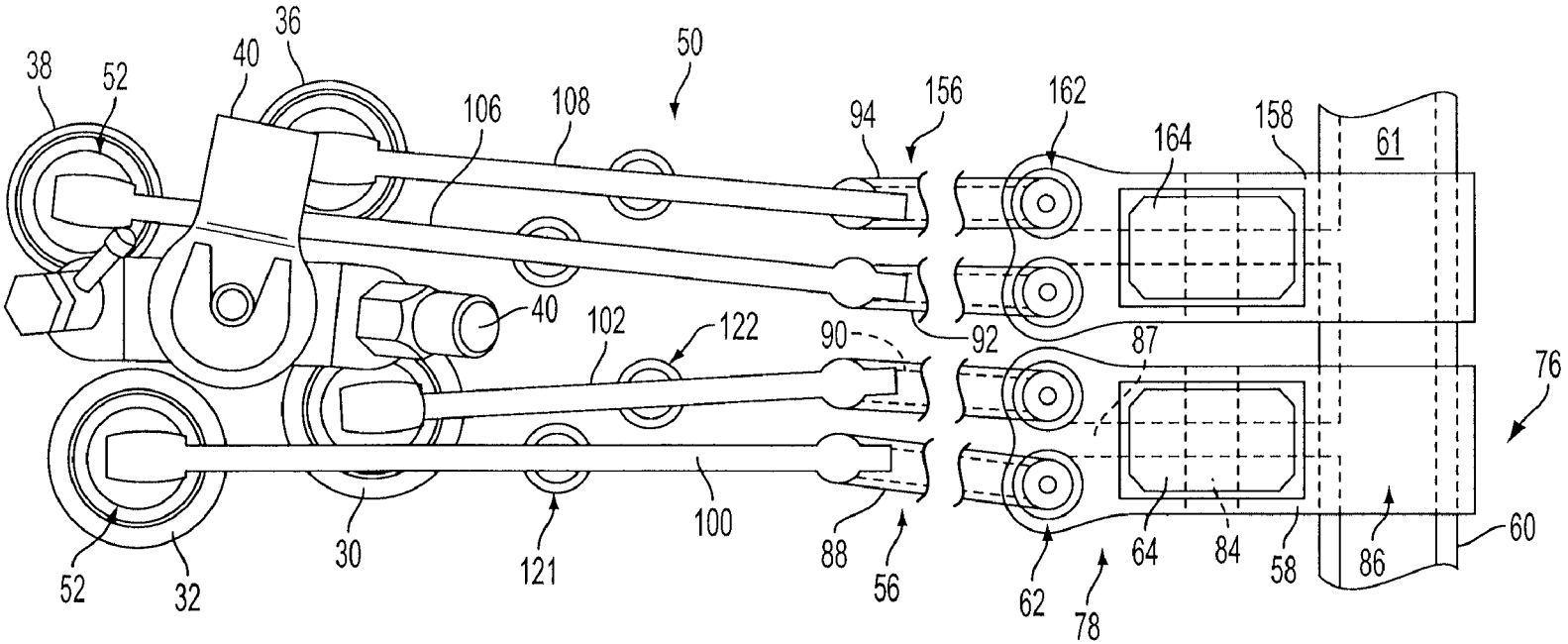
FIG. 3 is a top-view of a valve train associated with one cylinder in a four-valve-per-cylinder engine having cam followers with multiple independent hydraulic lash adjusters according to one embodiment of the present disclosure.

As illustrated in FIGS. 1-3, a method for operating engine 10 and valvetrain 50 according to the present disclosure includes actuating at least two gas exchange valves, such as intake valves 30, 32 or exhaust valves 36, 38, substantially simultaneously using at least two corresponding pushrods (88, 90 or 92, 94) and rocker arms (100, 102 or 106, 108) coupled to a common cam follower (58 or 158). As illustrated and described in greater detail with reference to FIGS. 4 and 5, each cam follower 58, 158 may include independently operable hydraulic lash adjusters to independently adjust lash associated with each pushrod and rocker arm. Alternatively, mechanical lash adjustment may be provided with two pushrods per cam follower easily accommodated by otherwise conventional four-valve per cylinder engines. Conventional mechanical lash adjustment may use a screw adjuster at the rocker arm on the pushrod end. The pushrod is typically a ball-cup end with the rocker arm adjuster screw having a ball end locked in position with a nut.

As best illustrated in the top view of a representative valvetrain 50 in FIG. 3, the present invention uses rocker arms 54 including rocker arms 100, 102, 106, and 108 having a one-piece body with a structurally integral flared portion to create a socket for engaging a pivot ball mounted on a fulcrum 120 (FIG. 1.) Each rocker arm 54 uses a coplanar cold-formed or stamped steel construction with a narrow width profile to facilitate packaging. Valves 30, 32 may be positioned at different distances relative to pushrods 88, 90 and require substantially different lengths for associated rocker arms 100, 102. In one embodiment, rocker arm 100 is about 40% longer than rocker arm 102. However, use of a thin profile coplanar rocker arm with a ball/socket pivot allows appropriate positioning of the ball/socket fulcrums 121, 122 to provide substantially identical rocker ratios to produce substantially identical valve motion for valves 30, 32. Additional details of a preferred rocker arm and fulcrum assembly are described in commonly owned and copending U.S. patent application Ser. No. 11/308,021 filed Mar. 3, 2006. Of course, the shaft-mounted cam followers of the present disclosure may be used with various other types and arrangements of rocker arms and associated fulcrums depending on the particular application and implementation.

Figure 4:
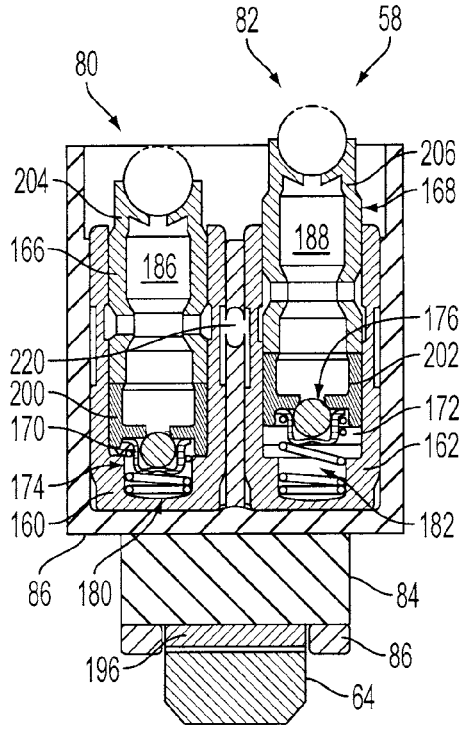
FIG. 4 is a cross-section illustrating operation of a shaft-mounted cam follower having dual independent hydraulic lash adjusters for operating a pair of valves from a single camshaft lobe according to one embodiment of the present disclosure.
Figure 5:
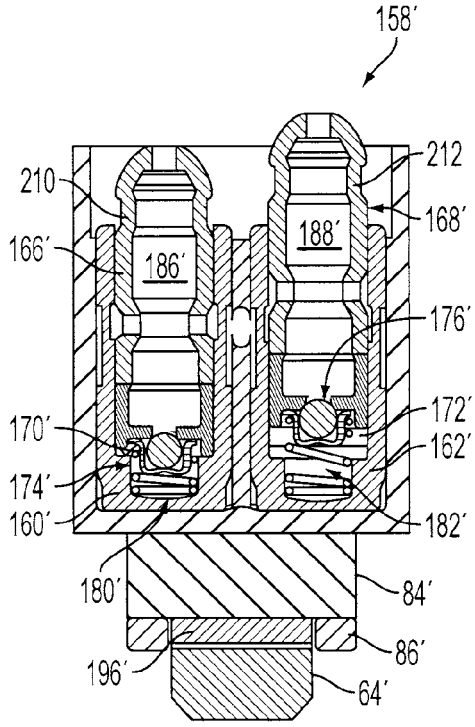
FIG. 5 is a cross-section illustrating another embodiment of a shaft-mounted cam follower with independent hydraulic lash adjusters according to the present disclosure.

As illustrated in the cross-section of FIG. 2 and the top view of FIG. 3, cam follower 58 includes a first end 76 with an opening or aperture pivotally mounted on stationary shaft 60. A second end 78 is adapted for coupling to at least two push rods 88, 90. In the embodiments illustrated in FIGS. 2-5, second end 78 of cam follower 58 is coupled to corresponding pushrods 88, 90 via independently operable lash adjusters 80, 82, which provide a compliant coupling using complementary ball/socket or convex/concave geometries of the plungers and associated pushrods as shown in FIGS. 4 and 5, for example. Roller 64 is mounted for rotation about roller axle 84, which is secured to housing 86 generally between first end 76 and second end 78. Housing 86 includes a channel, passage, or bore 87 that is coupled to a corresponding channel or bore 61 of stationary shaft 60 to provide pressurized lubricating oil from the engine lubrication system for operation of hydraulic lash adjusters 62 as explained in greater detail with reference to FIGS. 4 and 5. A bore or channel 57 may be provided in pushrods 56 to provide lubricating oil from lash adjusters 62 to lubricate the couplings between pushrods 56 and rocker arms 54 and lash adjusters 62.

FIGS. 4 and 5 illustrate alternative embodiments of a shaft-mounted cam follower having at least two independent hydraulic lash adjusters according to the present disclosure. Cam followers 58 and 158' have similar construction and operating principles so that the following description with reference to cam follower 58 of FIG. 4 applies also to cam follower 158' of FIG. 5 with differences as noted.

Cam follower 58 includes a roller 64 mounted for rotation about an axle 84 secured to housing or body 86. A bearing 196 or similar device facilitates rotation of roller 64 about axle 84 when in contact with a corresponding camshaft lobe. Housing 86 includes axial bores with corresponding sleeves 160, 162 fixed therein and each having a closed end and an open end. Each sleeve 160, 162 includes an axially movable plunger 166, 168 disposed therein to define a variable volume high-pressure chamber 170, 172 between the closed end and the plunger. Check valves 174, 176 are disposed within corresponding high pressure chambers 170, 172 to control flow of hydraulic fluid from reservoirs 186, 188 disposed within plungers 166, 168 into chambers 170, 172. Springs 180, 182 act on associated plungers 166, 168 to reduce lash when hydraulic pressure is reduced, such as when the engine is shut off, for example.

Shaft-mounted cam follower 58 includes two-part plungers 166, 168 with a lower plunger member or base 200, 202 and an upper plunger member or coupling 204, 206. Upper plunger members 204, 206 include a generally concave hemispherical geometry forming a socket for coupling to a corresponding pushrod having a generally convex hemispherical end or ball-shaped end. Shaft-mounted cam follower 158' has two-part plungers 166', 168' with upper members or couplers 210, 212 having generally convex hemispherical or ball-shaped ends adapted for coupling to corresponding pushrods having concave hemispherical ends forming a socket. As shown in FIGS. 4 and 5, the upper members of the plungers include an orifice to supply lubricating oil through a channel in corresponding pushrods to the corresponding rocker arms as previously described.

In operation, independent mechanical or hydraulic lash adjusters essentially eliminate any lash or clearance between the valve train components under varying operating and ambient conditions to provide consistent and reliable valve actuations including repeatable valve opening and closing times and peak lift values. As the length of an associated pushrod varies due to temperature variation or wear, hydraulic fluid from a pressurized supply is fed through channel 61 of stationary shaft 60 into bore 87 of housing 86 of cam follower 58. The pressurized hydraulic fluid, which is preferably engine lubricating oil, flows through transverse bore 220 into reservoirs 186, 188. A small amount of hydraulic fluid passes through check valves 174, 176 into high-pressure chambers 170, 172 moving plungers 166, 168 away from closed end of sleeves 160, 162 to remove any lash or clearance between couplers 204, 206 and corresponding pushrods and rocker arms. As such, the force generated by the cam lobe rotating in contact with roller 150 is transferred through housing 86 to sleeves 160, 162 and through the hydraulic fluid within chambers 170, 172 to plungers 166, 168. If the pushrod increases in length due to thermal expansion, hydraulic fluid escapes very slowly from chambers 170, 172 between plungers 166, 168 and sleeves 160, 162 to reduce the volume contained within an associated pressure chamber 170 or 172.

The lash adjusters associated with each shaft-mounted cam follower operate independently from one other to facilitate more precisely synchronized actuation of valves associated with each cam follower as compared to a bridged implementation using a single pushrod and lash adjuster. As such, the individual lash compensation accommodates variations in valve spring force, valve and/or valve seat wear, thermal effects, etc. to provide coupled, synchronous motion for two or more valves associated with a particular cam lobe.

As such, the present disclosure includes embodiments of a shaft-mounted cam follower with independent lash adjusters for operating two or more valves substantially simultaneously. Embodiments according to the present disclosure include a dedicated lash adjuster for each valve associated with a particular cam follower to compensate for thermal, wear, and tolerance effects and to insure that the valve motion remains very close to the design intent throughout the life of the engine. A common cam follower according to the present disclosure may reduce or eliminate noise, vibration, and harshness associated with valve pairs failing to open or close together and/or having different or higher than intended seating velocities. The independently operable lash adjusters within a common follower provide coupled, synchronous motion for each valve pair and allow individual compensation for valve spring force differences, differences in valve/seat wear, and differences due to the rocker arm force not being applied at the mid-point between valve centerlines. In addition, the cam followers of the present disclosure eliminate wear mechanisms associated with bridged valvetrain implementations, such as pitching and rolling of the bridge resulting in increased stresses on the bridge/rocker arm interface and undesirable contact between the bridge and valve stem tips. A common follower with multiple independently operable hydraulic lash adjusters pivoting on a fixed shaft may reduce the moving mass of the valvetrain to improve performance. A shaft mounted cam follower according to the present disclosure may also reduce machining complexity of the engine block and/or facilitate weight reduction by reducing or eliminating structural features associated with a reciprocating lifter bore in the engine block.

While the best mode has been described in detail, those familiar with the art will recognize various alternative designs and embodiments within the scope of the following claims. Several embodiments have been compared and contrasted. Some embodiments have been described as providing advantages or being preferred over other embodiments in regard to one or more desired characteristics. However, as one skilled in the art is aware, one or more characteristics may be compromised to achieve desired system attributes, which depend on the specific application. These attributes include, but are not limited to: cost, strength, durability, life cycle cost, marketability, appearance, packaging, size, serviceability, weight, manufacturability, ease of assembly, etc. The embodiments discussed herein that are described as inferior to another embodiment with respect to one or more characteristics are not outside the scope of the invention.

What is claimed:

1. A multiple cylinder internal combustion engine having a valvetrain with a camshaft disposed within an engine block, the engine including at least two intake valves or at least two exhaust valves operated by a common camshaft lobe, the engine comprising:

a stationary shaft disposed generally parallel to the camshaft a cam follower having a first end with an opening concentrically and pivotally mounted on the stationary shaft, a second end adapted for coupling to at least two pushrods, each pushrod associated with one of the at least two intake valves or exhaust valves, and a roller mounted on a roller axle disposed generally between the first and second ends, the roller contacting the common camshaft lobe;

a rocker arm associated with each pushrod for actuating one of the at least two intake valves or at least two exhaust valves; and the cam follower comprises:

at least two independent lash adjusters, each lash adjuster associated with a corresponding pushrod and rocker arm.

2. The engine of claim 1 wherein the at least two independent lash adjusters comprise:

at least two independent hydraulic lash adjustment mechanisms.

3. The engine of claim 1 wherein the stationary shaft is disposed within the engine block and includes a channel for supplying pressurized oil to the hydraulic lash adjustment mechanisms.

4. A multiple cylinder internal combustion engine having a valvetrain with a camshaft disposed within an engine block, the engine including at least two intake valves or at least two exhaust valves operated by a common camshaft lobe, the engine comprising:

a stationary shaft disposed generally parallel to the camshaft a cam follower having a first end with an opening concentrically and pivotally mounted on the stationary shaft, a second end adapted for coupling to at least two pushrods, each pushrod associated with one of the at least two intake valves or exhaust valves, and a roller mounted on a roller axle disposed generally between the first and second ends, the roller contacting the common camshaft lobe;

a rocker arm associated with each pushrod for actuating one of the at least two intake valves or at least two exhaust valves;

wherein the cam follower comprises:

a housing;

a first sleeve disposed within a first bore in the housing and having a closed end and an open end;

a first plunger disposed within the first sleeve and defining a first high-pressure chamber between the closed end and the first plunger;

a first check valve disposed between the first plunger and the first sleeve for controlling flow of hydraulic fluid from the first plunger into the first high-pressure chamber, the hydraulic fluid in the high-pressure chamber along with the plunger spring operating to remove lash associated with a first push rod, first rocker arm, and first valve;

a second sleeve disposed within a second bore in the housing and having a closed end and an open end;

a second plunger disposed within the second sleeve and defining a second high-pressure chamber between the closed end and the second plunger; and a second check valve disposed between the second plunger and the second sleeve for controlling flow of hydraulic fluid from the second plunger into the second high-pressure chamber, the hydraulic fluid in the second high-pressure chamber along with the plunger spring operating to remove lash associated with a second push rod, second rocker arm, and second valve.

5. The engine of claim 4 wherein each of the first and second plungers comprises:

a lower plunger member contacting a corresponding check valve; and an upper plunger member disposed between the lower plunger member and an associated pushrod, the upper plunger member adapted for coupling with the associated pushrod and having an orifice for supplying hydraulic fluid to the associated pushrod.

6. The engine of claim 5 wherein the upper plunger member includes an orifice in a generally convex hemispherical end for coupling to the associated pushrod.

7. A valvetrain for a multiple cylinder internal combustion engine having a camshaft disposed within an engine block for operating two intake valves or two exhaust valves from a single camshaft lobe, the valvetrain comprising:

a cam follower having a first end with an opening concentrically mounted for pivoting about a stationary shaft extending generally parallel to the camshaft in the engine block, the cam follower having a second end with first and second hydraulic lash adjusters positioned above a roller for contacting the camshaft lobe;

first and second rocker arms each associated with a respective one of the two valves; and first and second pushrods extending between the first and second lash adjusters of the cam follower and first and second rocker arms, respectively.

8. The valvetrain of claim 7 wherein the two valves are intake valves associated with the same cylinder.

9. The valvetrain of claim 7 wherein the first and second lash adjusters comprise hydraulic lash adjusters having a high-pressure chamber containing a variable amount of hydraulic fluid to remove lash from a respective pushrod, rocker arm, and valve assembly.

10. A cam follower for an internal combustion engine having a pushrod valvetrain including a camshaft and a stationary shaft disposed within an engine block, the stationary shaft extending generally parallel to the camshaft, the cam follower comprising:

a housing having a first end with an opening for pivotal mounting to the stationary shaft and a second end having first and second hydraulic lash adjusters at least partially disposed within the housing, each having one end adapted for coupling with a corresponding pushrod, the lash adjusters including a variable volume chamber fillable with hydraulic fluid supplied through the housing from the stationary shaft to adjust axial distance of a corresponding pushrod relative to the housing; and a roller for contacting a camshaft lobe, the roller being mounted for rotation about an axle mounted in the housing.

11. The cam follower of claim 10 wherein the first and second lash adjusters include a generally hemispherical end for coupling with a corresponding generally hemispherical end of a pushrod.

12. The cam follower of claim 11 wherein the generally hemispherical end is convex.

13. The cam follower of claim 10 wherein the first and second hydraulic lash adjusters comprise:

a sleeve disposed within a corresponding bore in the housing and having a closed end and an open end;

a plunger disposed within the sleeve and axially movable relative thereto defining a variable volume high-pressure chamber between the closed end and the plunger; and a check valve disposed between the plunger and the sleeve for controlling flow of hydraulic fluid from the plunger into the high-pressure chamber.

14. A method for actuating at least two intake valves or at least two exhaust valves associated with a single cylinder in a multiple cylinder internal combustion engine having a camshaft disposed within an engine block, the method comprising:

opening the at least two gas exchange valves substantially simultaneously using at least two corresponding pushrods and rocker arms coupled to a common cam follower mounted for pivoting about a stationary cylindraceous shaft extending generally parallel to the camshaft;

wherein the common cam follower independently adjusts lash associated with each pushrod and rocker arm.

15. The method of claim 14 wherein the internal combustion engine includes four valves per cylinder and wherein the step of actuating comprises actuating two intake valves.

16. The method of claim 14 further comprising positioning the stationary shaft within an engine block above the camshaft.

17. A method for actuating at least two intake valves or at least two exhaust valves associated with a single cylinder in a multiple cylinder internal combustion engine having a camshaft disposed within an engine block, the method comprising:

opening the at least two gas exchange valves substantially simultaneously using at least two corresponding pushrods and rocker arms coupled to a common cam follower mounted for pivoting about a stationary cylindraceous shaft extending generally parallel to the camshaft; and automatically adjusting for lash in the at least two corresponding pushrods and rocker arms by supplying pressurized hydraulic fluid to independent lash adjusters of the common cam follower.

18. The method of claim 17 wherein the step of supplying comprises supplying pressurized hydraulic fluid to the common cam follower through the stationary shaft.

* * * * *